United States Patent [19]

Sayles

[11] Patent Number: 4,655,859

[45] Date of Patent: Apr. 7, 1987

[54] AZIDO-BASED PROPELLANTS

[75] Inventor: David C. Sayles, Huntsville, Ala.

[73] Assignee: The United States of America as represented by the Secretary of the Army, Washington, D.C.

[21] Appl. No.: 153,818

[22] Filed: May 21, 1980

[51] Int. Cl.[4] ..... C06B 45/10

[52] U.S. Cl. ..... 149/19.2; 149/19.6; 149/19.91; 149/19.3; 149/20

[58] Field of Search ..... 149/19.1, 19.6, 19.3, 149/19.91, 19.2, 20

[56] References Cited

U.S. PATENT DOCUMENTS

| | | | |
|---|---|---|---|
| 3,844,855 | 10/1974 | Plomer | 149/19.1 |
| 3,878,002 | 4/1975 | Baldwin | 149/19.91 |
| 3,914,139 | 10/1975 | Jones et al. | 149/19.91 |
| 3,932,241 | 1/1976 | Sayles | 149/19.3 |
| 3,933,542 | 1/1976 | Childs et al. | 149/19.3 |
| 3,971,681 | 7/1976 | Rains et al. | 149/19.8 |
| 4,072,546 | 2/1978 | Winer | 149/20 |
| 4,078,953 | 3/1978 | Sayles | 149/19.4 |
| 4,133,706 | 1/1979 | Shoults | 149/19.2 |
| 4,268,450 | 5/1981 | Frankel et al. | 149/19.6 |
| 4,269,637 | 5/1981 | Flanagan | 149/19.91 |

*Primary Examiner*—Edward A. Miller
*Attorney, Agent, or Firm*—William G. Gapcynski; Werten F. W. Bellamy; Jack W. Voight

[57] ABSTRACT

A high energy, high performance, ultrahigh-burning rate composite propellant results when 2-azidoethyl acrylate is copolymerized with acrylic acid and is employed as the binder system for the composite propellant. The energetic binder when used in an amount of about 4.25 weight percent of an azido-based propellant composition as compared to a ethyl acrylate binder system results in a specific impulse increase from about 264 (lb-s/lb) to about 275 (lb-s/lb), and a burning rate increase from about 13.7 ips to about 19.8 ips at 1000 psia, and a burning rate increase from about 21.6 ips to about 30.2 ips at 2000 psia. The other propellant ingredients comprise a high solids loading of ammonium perchlorate, aluminum flake and aluminum powder, a burning rate catalyst of carboranylmethyl propionate, graphite linters, the crosslinking and curing agent 4,5-epoxycyclohexylmethyl 4',5'-epoxycyclohexylcarboxylate (ERL-4221), tris-1,2,3[bis(1,2-difluoroamino)ethoxy]propane (TVOPA), and a processing aid of lecithin.

2 Claims, No Drawings

AZIDO-BASED PROPELLANTS

DEDICATORY CLAUSE

The invention described herein may be manufactured, used, and licensed by or for the Government for governmental purposes without the payment to me of any royalties thereon.

BACKGROUND OF THE INVENTION

Acrylates have been employed as binder ingredients for solid propellant compositions. Acrylates which have been copolymerized with acrylic acid have also been employed as a copolymerized binder system. Taken an additional step further, acrylates have been employed as a member of a terpolymer system for a propellant binder system. As an example, a terpolymer comprised of butadiene, carboranyl methacrylate (CMA), and acrylic acid was disclosed and claimed in U.S. Pat. No. 3,914,206 by Chester W. Huskins and assigned to The United States of America as represented by the Secretary of the Army. The burning rate of the propellant containing CMA of about 75% of the terpolymer (or of about 15% CMA of the propellant composition based on 20% use of the terpolymer) resulted in a burning rate of about 3.5 inches per second as compared to a burning rate of about 0.25 inches per second for 0% CMA, both measured at 1000 psia. Thus, the terpolymer served as a combination binder and burning rate catalyst for the solid propellant compositions to achieve improved burning rate.

Thus, the polymeric systems employing an acrylate have proven to be useful as a binder for solid propellants. They are compatible with a wide variety of propellant ingredients such as the carboranes, difluoroamio compounds, oxidizers, and additives. These propellents employing acrylates are easily cured with epoxy type curing agents. The mechanical properties have been of acceptable values for propellants subjected to average accelerations. The burning rates have also been of acceptable values in the range of about 14 inches per second at 1000 psia and in the range of about 22 inches per second at 2000 psia.

Because of the acceptability of acrylates for their intended uses, improvements in the specific impulse due to the use of an energetic acrylate in the binder system would offer an additional advantage.

Therefore, an object of this invention is to provide an energetic acrylate for use in a solid propellant composition to yield a higher specific impulse and a higher burning rate for the propellant composition.

Another object of this invention is to provide a high energy, high performance, ultrahigh-burning rate composite propellant which employs an energetic acrylate copolymerized with acrylic acid as the binder system.

SUMMARY OF THE INVENTION

The binder system of this invention begins with the preparation of 2-azidoethanol ($N_2CH_2.CH_2OH$) by an established procedure followed by conversion of the 2-azidoethanol to 2-azidoethyl acrylate by continuously removing the water as the compound is formed. The final binder ingredient which is a copolymer of 2-azidoethyl acrylate-acrylic acid is prepared by an addition schedule which is followed by refluxing the complete mixture overnight.

The preferred energetic binder which is a copolymer of about 95 parts 2-azidoethyl acrylate to about 5 parts of acrylic acid is employed in an amount of about 3 to about 8 weight percent of the propellant composition. The burning rate increase of about 45 percent is achieved when about 4.25 weight percent of the energetic binder is used in place of about 3.06 weight percent of ethyl acrylate. This increase is achieved with a 1.2 weight percent decrease in ammonium perchlorate oxidizer which makes the increase due to the energetic binder even more impressive.

The energetic binder of this invention is employed in a composite propellant composition with a plasticizer of TVOPA, a curative and crosslinker of ERL-4221, a carboranyl burning rate catalyst, graphite linter, aluminum powder, aluminum flake, ammonium perchlorate, and lecithin processing aid.

DESCRIPTION OF THE PREFERRED EMBODIMENT

The energetic binder of this invention is a copolymer of 2-azidoethyl acrylate and acrylic acid. The starting compound 2-azidoethanol ($N_3CH_2.CH_2OH$) is prepared in accordance with the procedure reported by:

Forster & Furz J. Chem. Soc. 93, 1867 (1908)

Fagley, Klein, & Albrecht, J. Am. Chem. Soc. 75, 3104 (1953) and was found to have the following characteristics:

| | |
|---|---|
| Molecular Weight | 87 |
| Boiling Point | 73°/20 mm<br>60°/8 mm |
| Density($d_4^{24}$) | 1.149 |
| Refractive Index($n_D^{25}$) | 1.45778 |

The conversion of 2-azidoethanol into 2-azidoethyl acrylate is accomplished by continuously removing the water as it is formed. One technique consists of heating acrylic acid (72 g, 1 mol) with a moderate excess of 2-azidoethanol (96 g, 1.1 mol) and a third component immiscible with water and capable of forming an azeotrope, (benzene, 300 ml). A small proportion of toluenesulfonic acid (0.1%) may be added to accelerate the rate of esterification. The azeotrope is distilled out continuously during the esterification, and condensed in a device which permits the removal of the water layer. The non-aqueous portion of the distillate is returned to the reactor.

The preferred method for the manufacture of the 2-azidoethyl acrylate-acrylic acid copolymer involves an incremental addition procedure which appears in Table I and which consists of initially charging the solvent (ethyl acetate) and the polymerization initiator (benzoyl peroxide) to a stainless steel reactor. These are heated to reflux, and the first increment (usually about 40%) of the monomer is then added. (This point is considered to be time zero insofar as sequencing of the procedure is concerned). The remaining monomers are added in four equal increments at specific times. After addition is complete, the complete mixture is refluxed overnight.

Table II presents the typical characteristics of the product: 2-azidoethyl acrylate-acrylic acid copolymer.

TABLE I

| PREPARATION OF 2-AZIDOETHYL ACRYLATE-ACRYLIC ACID COPOLYMER |
|---|
| Formulation |
| Copolymer Ratio |

TABLE I-continued

| PREPARATION OF 2-AZIDOETHYL ACRYLATE-ACRYLIC ACID COPOLYMER | |
|---|---|
| Formulation | |
| 2-Azidoethyl Acrylate-Acrylic Acid Ratio | 95/5 |
| Ingredients (Weight %) | |
| Ethyl Acetate | 61.4 |
| 2-Azidoethyl Acrylate | 50.7 |
| Acrylic Acid | 2.0 |
| Benzoyl Peroxide | 0.1 |
| Incremental Addition Schedule (Weight % 2-Azidoethyl Acrylate/Weight % Acrylic Acid) | |
| 0 (min.) | 20.28/0.80 |
| 25 | 7.61/0.30 |
| 50 | 7.61/0.30 |
| 80 | 7.61/0.30 |
| 110 | 7.58/0.30 |

(<2000) remain in solution, and usually comprise of less than 2% of the total specimen (by weight). These species need to be removed, otherwise, they would have an undesirable effect on the value obtained for the number average molecular weight. The solution is then decanted, and the precipitated copolymer collected and dried. Three solutions of the polymer (0.5, 0.10, and 0.05 g/5 ml) are then prepared in benzene solution. The apparent mean average molecular weight of the sample is determined for each concentration; and then it is plotted against each concentration. Extrapolation of the curve to zero concentration gives the mean average molecular weight of the sample. The highest molecular weight measurable on this machine is 20,000.

Table III contains a comparison of difluoroamino-based, ultrahigh-burning rate propellants which contain ethyl acrylate and 2-azidoethyl acrylate.

TABLE III

| COMPARISON OF PROPELLANTS CONTAINING ETHYL ACRYLATE AND 2-AZIDOACRYLATE | CONTROL PROPELLANT A WT. % | EXPERIMENTAL PROPELLANT B WT. % | EXPERIMENTAL PROPELLANT B WT. % RANGE |
|---|---|---|---|
| INGREDIENT | | | |
| Trisvinoxypropyl Adduct (TVOPA)* | 27.54 | 27.54 | 24–30 |
| 2-Azidoethyl Acrylate-Acrylic Acid Copolymer | 0.00 | 4.25 | 3–8 |
| Ethyl Acrylate | 3.06 | 0.00 | |
| ERL-4221** | 1.4 | 1.4 | 0.75–1.5 |
| Carboranylmethyl Propionate | 4.0 | 4.0 | 2.0–6.0 |
| Graphite Linter (100 mμ) | 2.0 | 2.0 | 1.0–3.0 |
| Aluminum Powder (Alcoal 123) | 11.0 | 11.0 | 10.0–12.0 |
| Aluminum Flake (IRECO 2010) | 1.0 | 1.0 | 0.5–2.0 |
| Ammonium Perchlorate (0.9 mμ) | 50.0 | 48.8 | 46.0–52.0 |
| Lecithin | 0.1 | 0.1 | 0.1–0.2 |
| Properties | | | |
| Theoretical Specific Impulse (lb-s/lb) | 264 | 275 | |
| Density (lb/in$^3$) | 0.064 | 0.066 | |
| Strand Burning Rates (ips) | | | |
| 1000 psia | 13.7 | 19.8 | |
| 2000 psia | 21.6 | 30.2 | |
| Pressure exponent | 0.68 | 0.67 | |
| End-of-Mix Viscosity (Kp @ 132° F.) | 17 | 12 | |

*tris-1,2,3[bis(1,2-difluoroamino)ethoxy]propane
**4,5-epoxycyclohexylmethyl 4'5'-epoxycyclohexylcarboxylate

TABLE II

| PRODUCT: 2-AZIDOETHYL ACRYLATE ACRYLIC ACID COPOLYMER | |
|---|---|
| Polymer Characteristics | |
| Non-Volatile Content (%) | 43 |
| Solution Viscosity (cps) | 3.0 |
| Number Average Molecular Weight (Mn) of The Precipitated Copolymer* | 20,000 |
| Mean Number Average Low Molecular Weight ($\overline{Mn}$) | 1700–1800 |
| Percentage of Low Molecular Weight Copolymer | 1.1 |
| Other Polymer Characteristics** | |
| Polymer Storage*** | |

*The Number Average Molecular Weight ($\overline{Mn}$) is carried out in a Mechrolab Vapor Pressure Osmometer which has been calibrated using benzil and polystyrene as standards ($\overline{Mn}$) = 10,300).
**To obtain a copolymer which has a lower molecular weight, the monomer concentration needs to be reduced and the polymerization initiator content needs to be increased.
***The product solution can be drained from the reactor into high-density polyethylene containers; stoppered to prevent loss of solvent and then stored indefinitely without any apparent degradation of the copolymer.

The sample is prepared for analysis using the following procedures: the copolymer solution is added slowly to a non-solvent, such as pentane or methanol, to precipitate the copolymer. Low molecular weight species The use of 2-azidoethyl acrylate-acrylic acid copolymer in a composite propellant composition provides multiple benefits. These benefits readily recognized from the data of Table III include an improvement in the theoretical specific impulse, an improvement in the burning rate, and a lowering of the pressure exponent. Other benefits that would be attractive for certain uses include a lower end-of-mix viscosity and a higher density which permits more deliverable energy per pound of propellant, if required, or reduced weight of propellant to achieve the same deliverable amount of thrust as compared to the propellant employing ethyl acrylate.

I claim:

1. An azido-based solid propellant composition having an improved burning rate comprising: a high energy plasticizer of tris-1,2,3[bis(1,2-difluoroamino)ethoxy]-propane in an amount from about 24 to about 30 weight percent of said propellant composition; a curative and crosslinking agent of 4,5-epoxycyclohexylmethyl 4'5'-epoxycyclohexylcarboxylate in an amount from about 0.75 to about 1.5 weight percent of said propellant composition; a carboranyl burning rate catalyst of carboranylmethyl propionate in an amount from about 2 to about 6 weight percent of said propellant composition; graphite linters of about 100 micrometers lengths in an amount from about 1 to about 3 weight percent of said propellant composition; aluminum powder in an amount from about 10 to about 12 weight percent of said propellant composition; aluminum flake in an amount from about 0.5 to about 2 weight percent of said propellant composition; ammonium perchlorate of about 0.9 micrometer diameter in an amount from about 46 to about 52 weight percent of said composition; a processing aid of lecithin in an amount from about 0.1 to about 0.2 weight percent of said propellant composition; and a binder of 2-azidoethyl acrylate-acrylic acid copolymer in an amount from about 3 to about 8 weight percent of said propellant composition.

2. The azido-based solid propellant composition of claim 1 wherein said high energy plasticizer of tris-1,2,3[bis(1,2-difluoroamino)ethoxy]propane is present in an amount of about 27.54 weight percent of said propellant composition; said curative and crosslinking agent of 4,5-epoxycyclohexylmethyl 4'5'-epoxycyclohexylcarboxylate is present in an amount of about 1.4 weight percent of said solid propellant composition; said carboranyl burning rate catalyst of carboranylmethyl propionate is present in an amount of about 4.0 weight percent of said solid propellant composition; said graphite linters are present in an amount of about 2.0 weight percent of said solid propellant composition; said aluminum powder is present in an amount of about 11.0 weight percent of said solid propellant composition; said aluminum flake is present in an amount of about 1.0 weight percent of said solid propellant composition; said ammonium perchlorate is present in an amount of about 48.8 weight percent of said solid propellant composition; said processing aid of lecithin is present in an amount of about 0.1 weight percent of said solid propellant composition; and said binder of 2-azidoethylacrylate-acrylic acid copolymer is present in an amount of about 4.25 weight percent of said solid propellant composition.

* * * * *